United States Patent [19]

Zavatkay

[11] 4,364,202

[45] Dec. 21, 1982

[54] VEHICLE WINDOW OPERATING MECHANISM

[75] Inventor: Robert J. Zavatkay, Torrington, Conn.

[73] Assignee: Barnes Group Inc., Bristol, Conn.

[21] Appl. No.: 173,863

[22] Filed: Jul. 30, 1980

[51] Int. Cl.[3] ..... E05F 11/48

[52] U.S. Cl. ..... 49/352; 49/375

[58] Field of Search ..... 49/352, 372, 374, 375

[56] References Cited

U.S. PATENT DOCUMENTS 3,675,371 7/1972 Golde et al. ..... 49/352

4,237,657 12/1980 Kazewych ..... 49/375 X

*Primary Examiner*—Kenneth Downey

*Attorney, Agent, or Firm*—Scrivener, Clarke, Scrivener and Johnson

[57] ABSTRACT

The disclosure is of a mechanism for raising and lowering a window, such as the window of an automobile, the mechanism being of the type in which a flexible belt or chain connected to the window is moved along a fixed track, and a window counterbalancing spring is provided.

1 Claim, 4 Drawing Figures

VEHICLE WINDOW OPERATING MECHANISM

SUMMARY OF THE INVENTION

The disclosure is of the operating mechanism for raising and lowering the window of a motor vehicle, the mechanism being of the type in which a perforated non-metallic belt which is connected to the window is moved along a fixed track by rotation of a toothed gear which meshes with the belt. A counter balance spring is wound by the belt on lowering the window and unwinds on raising the window in order to partially counterbalance its weight, and in accordance with the invention the spring is a backwound constant force spiral coil spring.

DESCRIPTION OF THE INVENTION

Figure 1:
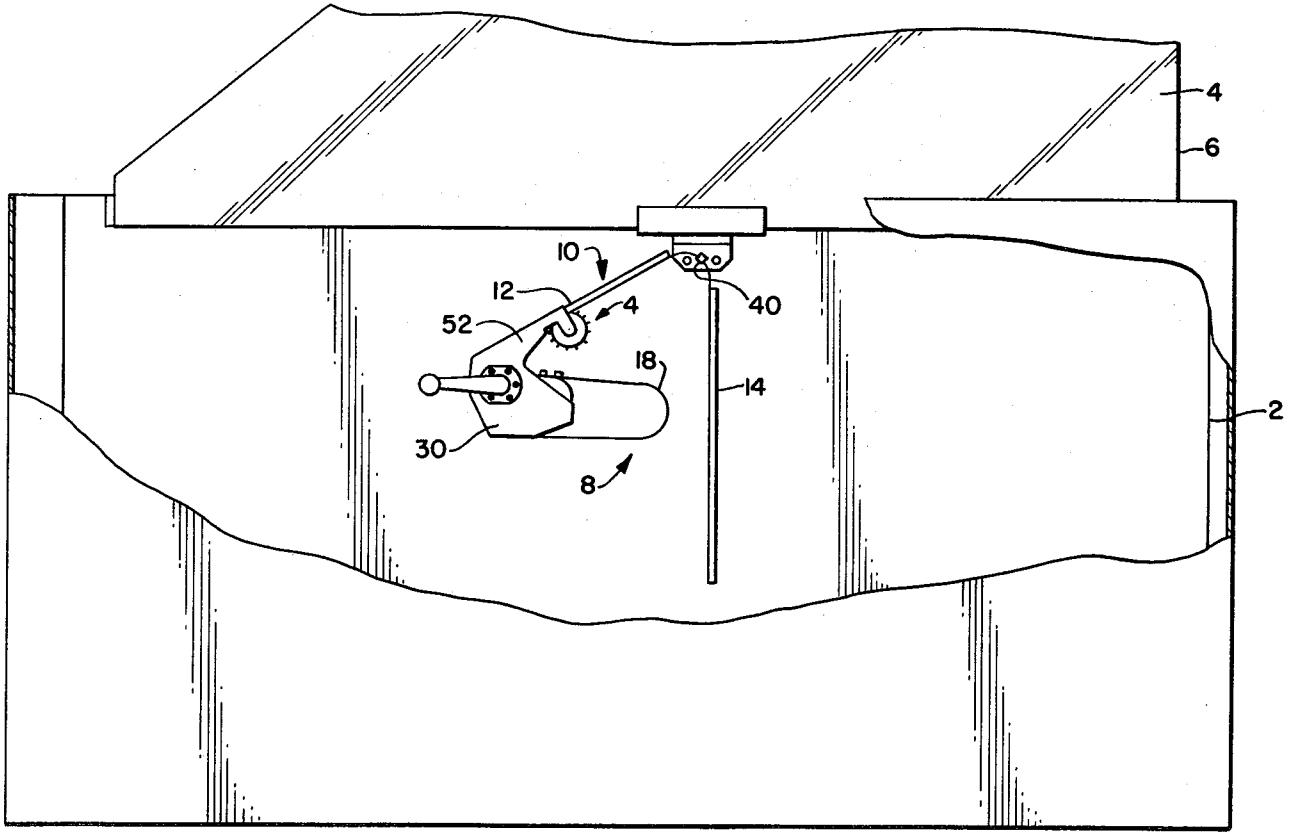
FIG. 1 is a fragmentary view of the door of an automobile embodying the invention.
Figure 2:
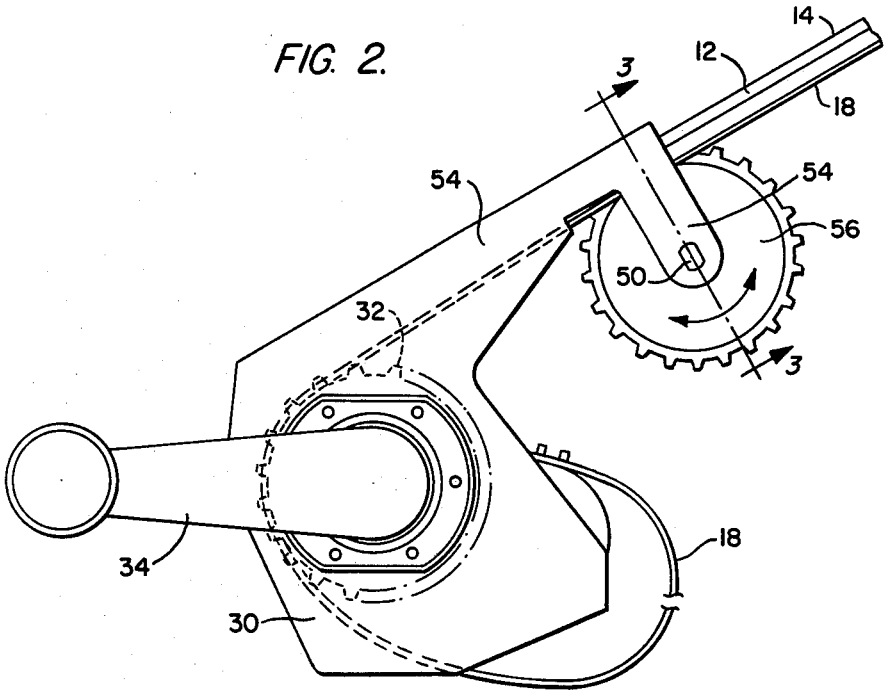
FIG. 2 is an enlarged view of the window operating mechanism provided by the invention.

In FIG. 1 of the drawings there is illustrated an automobile door 2 including a window pane 4 slidably mounted in a frame 6 for upward and downward movement. The window pane is moved upwardly and downwardly by a window regulator mechanism 8. This mechanism comprises, first, a rigid track 10 having an upwardly inclined part 12 and a downwardly extending part 14. The juncture between the parts 12, 14 is positioned adjacent the lower edge of the frame 6 in which the window pane is mounted and the parts 12, 14 are separated at this point. Each of the parts of the track has an elongated slot or opening 16 extending along its length, and within the track and extending along the length of all of the parts is a flexible non-metallic belt 18 which is provided throughout its length with equally spaced sprocket openings 20 which pass over and along the slot opening 16 and are acessible through that opening. The means for moving the belt along the track comprises a casing 30 which is mounted on the door below the window frame and has within it a gear 32 which is mounted on rotatable shaft (not shown) to which a window regulator handle 34 is connected. The gear has external gear teeth which engage the sprocket openings 20 in the belt. Adjacent the lower edge of the window frame where the parts 12, 14 of the track are separated the belt 18 is connected to the window pane adjacent its lower edge at 40. It will be apparent that operation of the handle 34 will rotate gear 32, causing its teeth to move the belt 18 along and through the track 10 thereby moving the connection 40 between the belt and the window pane upwardly or downwardly depending on the direction of rotation of the regulator handle. These described parts are generally conventional.

Means are provided by the invention for exerting force on the window while it is being raised thereby to counter-balance part of the weight of the window and assist the operator in raising it. Such means are shown at A and comprise a shaft 50 which extends transversely of the track and belt and is non-rotatably mounted in the upstanding spaced arms 52, 54 which forms part of the casing 30. A hollow cylindrical gear housing 56 is rotatably mounted on shaft 50 and has an annular series of gear teeth 58 on its exterior surface 60. Within the housing 56 the shaft is provided with an enlarged part 62 with an annular spiral shaped external surface. A constant tension backwound spiral spring 64 surrounds the part 62 of the shaft and has its outer end connected to the annular wall of the housing and its inner end engaged with radial surface 66 at the end of the spiral surface of the shaft part 62. The gear teeth 58 on the spring housing 56 are in mesh with the sprocket openings 20 in the belt 18 through the slot opening in the track part 12.

Figure 3:
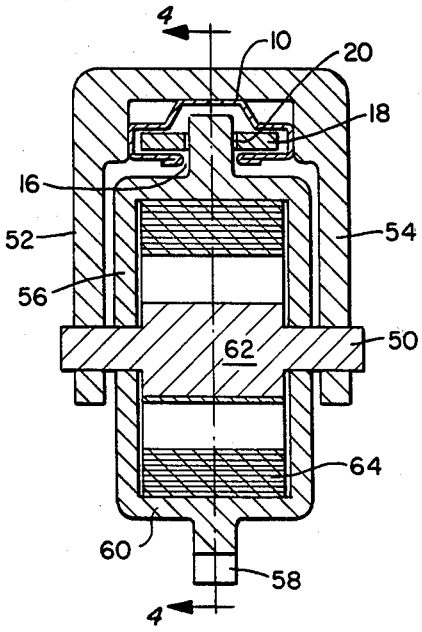
FIG. 3 is a cross sectional view taken on line 3—3 of FIG. 2.
Figure 4:
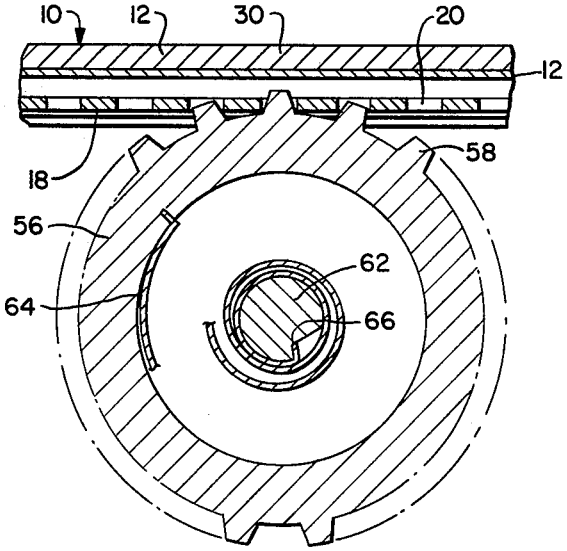
FIG. 4 is a cross sectional view taken on line 4—4 of FIG. 3.

In operating the window the handle 34 is rotated to operate gear 32, the teeth of which move the belt 18 along the track parts, thus raising or lowering the window depending on the direction of rotation of the handle. The spring 64, being backwound, is normally adjacent the inner periphery of the housing 56 with its coils bunched as shown in FIGS. 3 and 4. Movement of the handle to lower the window causes movement of the belt in the track parts with consequent rotation of gear housing 56. The inner end of spring 64, being engaged by the radial surface 66 on the shaft, is held from movement, whereby rotation of the gear housing and the connected outer end of the spring causes the spring to wind down toward or onto the shaft, depending on the extent of operation of the handle, thereby storing energy in the spring. When the handle and its connected operating parts are operated to raise the window the rotation of the spring housing moves the spring toward or to its normal position thereby releasing its stored energy to the window and tending to raise it. The provision of a constant tension backwound spring results in more constant force through the operating cycle than the conventional types of springs.

I claim:

1. For use with an automobile door having a window opening and a window slidably mounted in the opening, a mechanism for raising and lowering the window comprising:

(a). a rigid track fixed to the door below the window opening and having a slot opening along its length, (b). a flexible non-metallic belt slidably mounted in the track and having a portion thereof connected to the lower part of the window, and having equally spaced perforations formed along its length which are accessible through the slot opening in the track, (c). operating means for the window comprising an externally toothed gear rotatably mounted on the door with its teeth meshing with the perforations in the belt, and a handle connected to the gear for operating the gear to move the belt along the track, (d). a fixed shaft mounted on the door adjacent the track, (e). a hollow cylindrical externally toothed casing rotatably mounted on the shaft with its teeth in meshed engagement with the perforations in the belt, and (f). a backwound spiral spring within the casing having its outer end fixed to the inner peripheral wall of the casing and its inner end fixed to the shaft, the spring being moved from its normal position adjacent the peripheral wall of the casing to its position adjacent the shaft on lowering the window and unwound to its normal position on raising the window.

* * * * *